US005125019A

United States Patent [19]

Evain et al.

[11] Patent Number: 5,125,019

[45] Date of Patent: Jun. 23, 1992

[54] X-RAY SCANNING TUBE WITH DEFLECTING PLATES

[75] Inventors: Bernard Evain, Issy Les Moulineaux; Horia Dumitrescu, Guyancourt; Jean-Marie Fourmigue, Paris, all of France

[73] Assignee: General Electric CGR SA, Issy Les Moulineaux, France

[21] Appl. No.: 494,444

[22] Filed: Mar. 16, 1990

[30] Foreign Application Priority Data

Mar. 24, 1989 [FR] France ..... 89 03888

[51] Int. Cl.[5] ..... H01J 35/30

[52] U.S. Cl. ..... 378/137; 378/121; 378/145

[58] Field of Search ..... 378/137, 138, 139, 145, 378/143, 121, 122, 119, 113, 16, 136

[56] References Cited

U.S. PATENT DOCUMENTS 3,962,582 6/1976 Holland et al. ..... 378/138
4,065,690 12/1977 Maeyama ..... 378/138
4,344,011 8/1982 Hayashi et al. ..... 378/138
4,631,742 12/1986 Oliver ..... 378/113
4,689,809 8/1987 Sohval ..... 378/138
4,764,947 8/1988 Lesensky ..... 378/136

FOREIGN PATENT DOCUMENTS 0030453 6/1981 European Pat. Off. .
0150364 8/1985 European Pat. Off. .
2536583 5/1984 France .

*Primary Examiner*—Janice A. Howell
*Assistant Examiner*—Don Wong
*Attorney, Agent, or Firm*—Oblon, Spivak, McClelland, Maier & Neustadt

[57] ABSTRACT

In an x-ray tube of the beam deflection type for a radiology apparatus, the stair-steps of the focusing device of the electron beam are extended by metallic deflecting electrodes placed in parallel relation to said stair-steps and electrically insulated from these latter by means of insulating layers. Said electrodes are brought to different potentials, the polarities and values of which depend on the direction and amplitude of deflection to be obtained.

10 Claims, 5 Drawing Sheets

X-RAY SCANNING TUBE WITH DEFLECTING PLATES

BACKGROUND OF THE INVENTION

1. Field of the Invention

This invention relates to an x-ray tube which is employed in particular in radiology in order to obtain an x-ray beam which can have different directions in space.

2. Description of the Prior Art

This type of x-ray tube is employed for example in diagnostic radiology for scanning a zone to be analyzed or for obtaining at least two x-ray beams having different energy characteristics and/or different angles of incidence on the zone to be analyzed.

A x-ray tube comprises, within a vacuum enclosure, a cathode constituted by a heated filament which emits electrons and by a focusing device which is mounted against the filament and focuses the electrons emitted on an anode which is brought to a positive potential with respect to the cathode. The point of impact of the electron beam on the anode constitutes the x-radiation source in the form of a beam.

In order to produce an angular displacement of the x-ray beam, it is generally proposed to displace the point of impact of the electron beam on the anode by making use of deflecting means. These deflecting means usually consist of magnetic or electrostatic lenses which are placed on the path of the beam or in proximity to said path between the cathode and the anode. Utilization of these lenses calls for not negligible power consumption by reason of the high kinetic energy of the beam electrons which is due to their high velocity as a result of a considerable potential difference between cathode and anode which is greater than one hundred kilovolts.

In French patent No. 2,538,948, there was proposed a scanning x-ray tube in which the focusing device has at least two metallic components which are electrically isolated from each other and from the filament so as to permit their independent polarization with respect to this latter and thus to obtain deflection of the electron beam.

FIG. 1 shows diagrammatically an x-ray tube of the type described in the patent application cited earlier. Within a vacuum enclosure represented in dashed outline by the rectangle 11, said x-ray tube comprises a filament 12, a focusing device 13 mounted against the filament 12 and an anode 14. The filament 12 and the focusing device 13 constitute a cathode C1. The focusing device 13 is constituted by a first metallic component 15 and a second metallic component 16 which are electrically isolated from each other by means of an insulating wall 17 rigidly fixed to an insulating base 18. The metallic components 15 and 16 are placed symmetrically on each side of the filament 12 with respect to a plane of symmetry which is perpendicular to the plane of FIG. 1. This plane of symmetry contains the axis of the filament 12 at right angles to the plane of FIG. 1 and is perpendicular to the base 18. The intersection of said plane of symmetry with the plane of FIG. 1 defines the axis 19 of the electron beam.

When equal voltages are applied to the metallic components 15 and 16, the cathode C1 emits an electron beam F along the axis 19, focusing of said beam being obtained by the geometry of the cathode C1.

In order to obtain a deflection of the electron beam, or in other words in order to give this latter a mean direction which is different from the emission axis 19, it is only necessary to introduce dissymmetry in the electric field produced around the filament 12 by giving different values to the voltages applied to the metallic components 15 and 16; one of these values can be zero but no value must be positive. A beam F' having an axis 19' is thus obtained in the case of a positive potential difference between the component 15 and the component 16; on the other hand, a beam F'' having an axis 19'' is obtained in the case of a negative potential difference between the component 15 and the component 16.

The x-ray tube which has just been described offers satisfactory deflection performances without requiring the application of unduly high voltages. However, focusing of the beam is not satisfactory for applications in which the x-ray source has to be a point source and the energy distribution of the x-ray beam must be uniformly and symmetrically distributed over its entire cross-section.

In order to overcome these disadvantages, the invention proposes an x-ray tube in which the functions of focusing and deflection are separated spatially at the level of the cathode.

SUMMARY OF THE INVENTION

The invention relates to an x-ray tube comprising within a vacuum enclosure a cathode which emits an electron beam and an anode which receives said beam and emits x-radiation, said cathode being constituted by an electron-emitting filament and by a device for focusing the electron beam. Said x-ray tube essentially comprises in addition two deflecting electrodes placed on each side of the electron beam and insulated from the cathode and from the anode, said electrodes being such that they can be brought to different potentials with respect to each other and with respect to the cathode potentials.

In accordance with the invention, the deflecting electrodes are each attached to the cathode by means of an insulating element and are constituted by metallic plates opposite to each other and parallel to the axis of the electron beam when there is no deflection.

DESCRIPTION OF THE PREFERRED EMBODIMENTS

Figure 1:
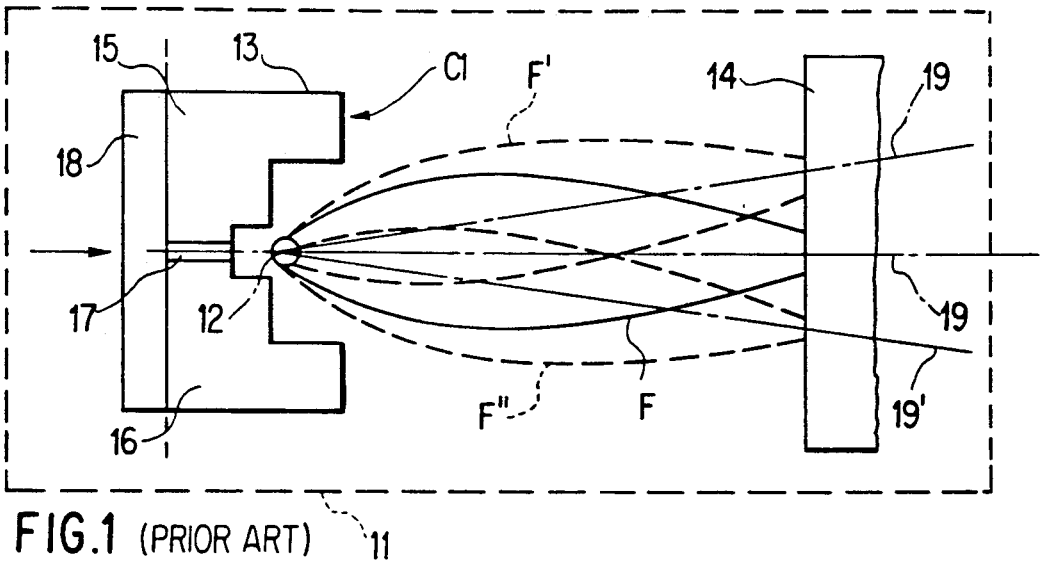
FIG.1 (PRIOR ART)
FIG. 1 is a diagram of an x-ray tube in accordance with the prior art.
Figure 2:
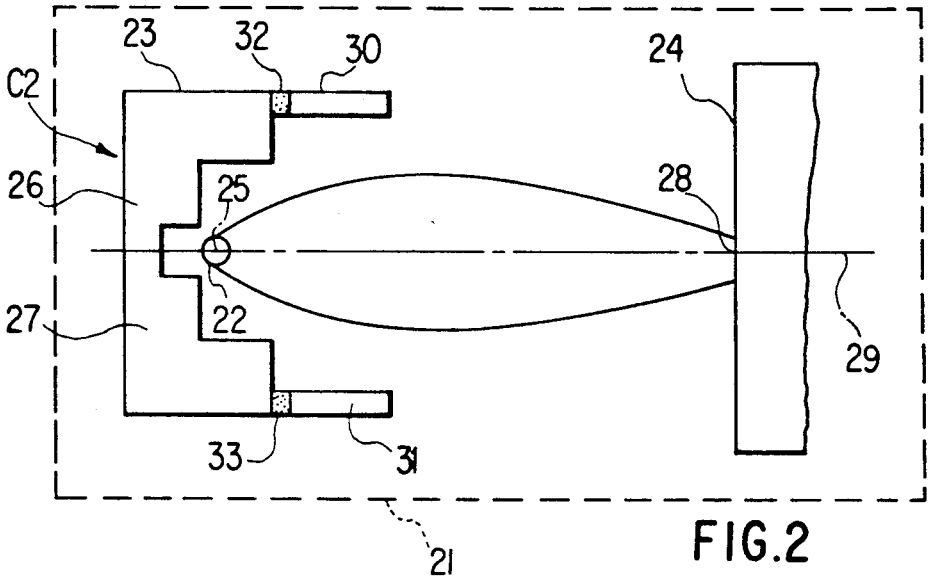
FIG. 2 is a diagram of an x-ray tube in accordance with the invention.

FIG. 2 shows diagrammatically an x-ray tube in accordance with the present invention. Within a vacuum enclosure represented by the frame 21 in dashed outline, said x-ray tube comprises a filament 22, a focusing device 23 and an anode 24. The focusing device 23 and the filament 22 constitute a cathode C2. The focusing device 23 is constituted by a single metallic component which is symmetrical with respect to a plane of symmetry perpendicular to the plane of FIG. 2 and containing the axis 25 of the filament 22 which is perpendicular to the plane of the figure. The intersection of said plane of symmetry with the plane of FIG. 2 defines the axis 29 of the electron beam.

In a known manner, the opposite and symmetrical faces 26 and 27 of the focusing device 23 are in the form of stair-steps, the first step of which is at the level of the filament 22. When a zero or positive voltage is applied to the metallic component 23 (by means not shown in FIG. 2), the electron beam is accordingly focused at a point 28 of the anode 24 which is located on the axis 29.

In accordance with the invention, deflection of the electron beam is obtained by means of metallic plates 30 and 31 which extend the stair-steps of the focusing device 23 and are placed symmetrically with respect to the plane of symmetry. Said plates are electrically insulated from the focusing device by means of insulating layers 32 and 33. These plates can be brought (by means not shown in FIG. 2) to different potentials with respect to each other, with respect to the metallic component 23 and with respect to the anode 24.

Thus, by applying a voltage of +2000 volts to the upper plate 30 and a voltage of −2000 volts to the lower plate 31, deflection of the beam towards the upper plate 30 is obtained. As can readily be understood, the deflection would be the reverse, or in other words towards the lower plate, if the voltage were reversed on the plates. The amplitude of deflection on the anode is approximately one millimeter when the cathode-anode distance is approximately two centimeters. Moreover, the length of the plates 30 and 31 in the direction of propagation is approximately three millimeters.

It is worthy of note that the amplitude of deflection is not proportional to the length of the plates as could be expected.

Figure 3:
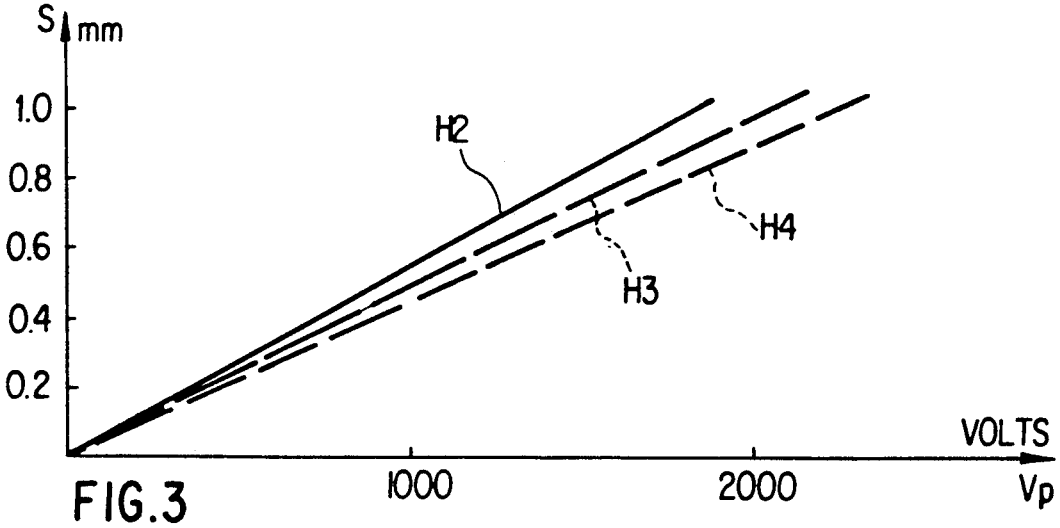
FIG. 3 is a diagram which serves to determine the optimum length of the deflecting electrodes.

This is shown in the diagram of curves H1, H2, H3 of FIG. 3 in which the deflection $\delta$ on the anode has been represented as a function of the voltage $V_p$ at absolute value applied to the plates 30 and 31 in respect of different respective lengths h1, h2 and h3 of said plates such that $h1<h2<h3$ whilst the cathode-anode voltage remains equal to approximately 140 kilovolts.

In this diagram, the greatest deflection has been obtained with the length h2 which is of intermediate value between h1 and h3.

The curves of FIG. 3 also show that the deflection on the anode is directly proportional to the voltages applied to the plates.

Figure 4A:
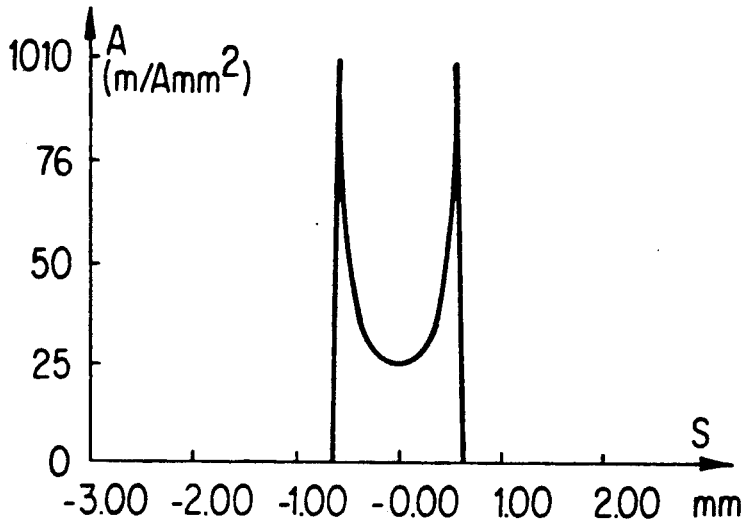
FIGS. 4*a* and 4*b* are diagrams showing the deflection of the beam and its energy distribution in respect of symmetrical polarizations of the deflecting electrodes with respect to ground potential.
Figure 4B:
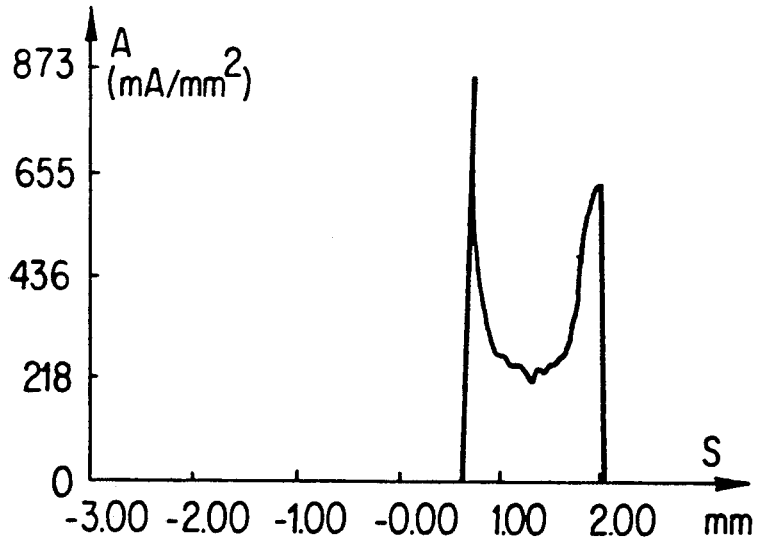

FIGS. 4*a* and 4*b* are diagrams showing the density A of energy distribution of the impact on the anode as a function of the distance $\delta$ of the impact with respect to the axis 29. The diagram of FIG. 4*a* corresponds to absence of polarization on the plates whilst FIG. 4*b* corresponds to a deflection obtained by applying polarization voltages of +2000 volts and −2000 volts. These diagrams show that there is a slight deterioration in the energy distribution of the impact in the case of that portion which is farthest away from the axis.

Figure 5A:
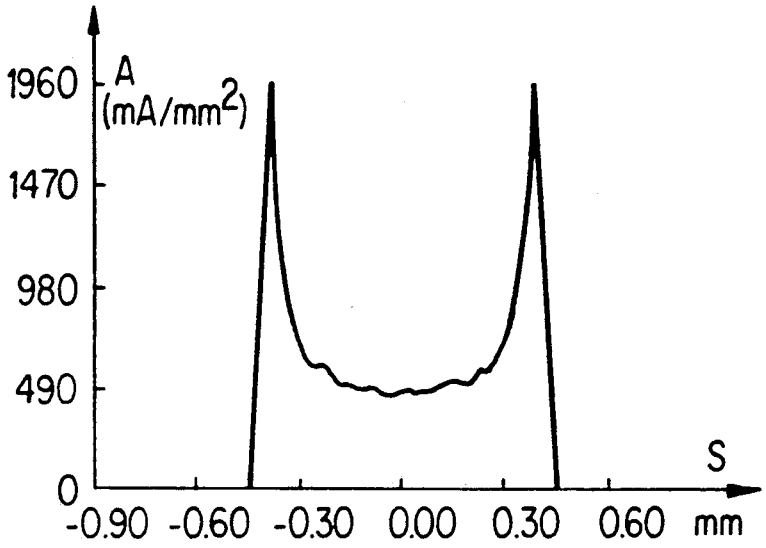
FIGS. 5*a* and 5*b* are diagrams showing the deflection of the beam and its energy distribution in the absence of polarization (FIG. 5*a*) of the deflecting electrodes or in respect of dissymmetrical polarization (FIG. 5*b*).

Instead of applying inverse voltages on the plates, it is possible to apply dissymmetrical voltages such as, for example, −500 volts on one plate and ground potential on the other. Smaller deflections may obviously be obtained but there is a deterioration in the energy distribution of the point of impact on the anode. This is shown in the diagrams of FIGS. 5*a* and 5*b* which are similar to those of FIGS. 4*a* and 4*b* but with a voltage applied to the cathode which is equal to one-half the voltage employed in the case of FIG. 4.

Figure 5B:
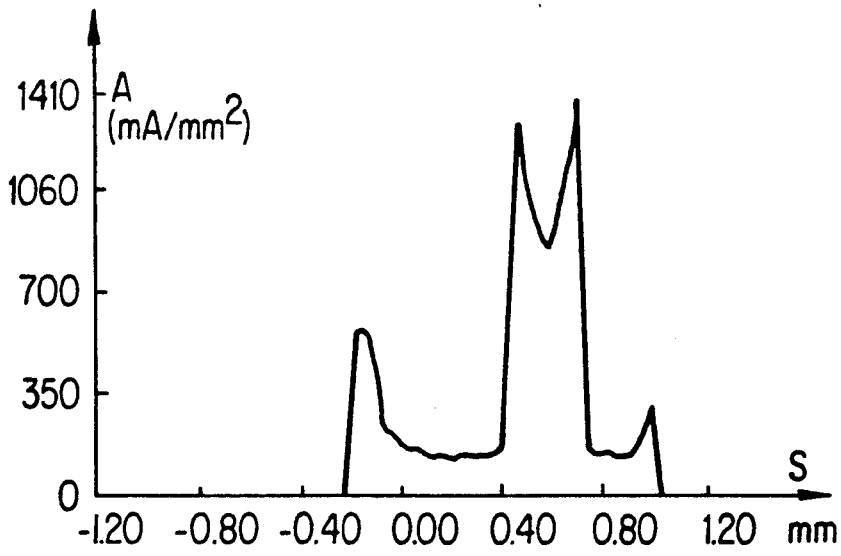

FIG. 5*b* shows that the energy distribution of the beam is less uniform on the diameter of the impact when the voltage applied to a plate is 500 volts whilst the other plate is connected to ground.

Figure 6:
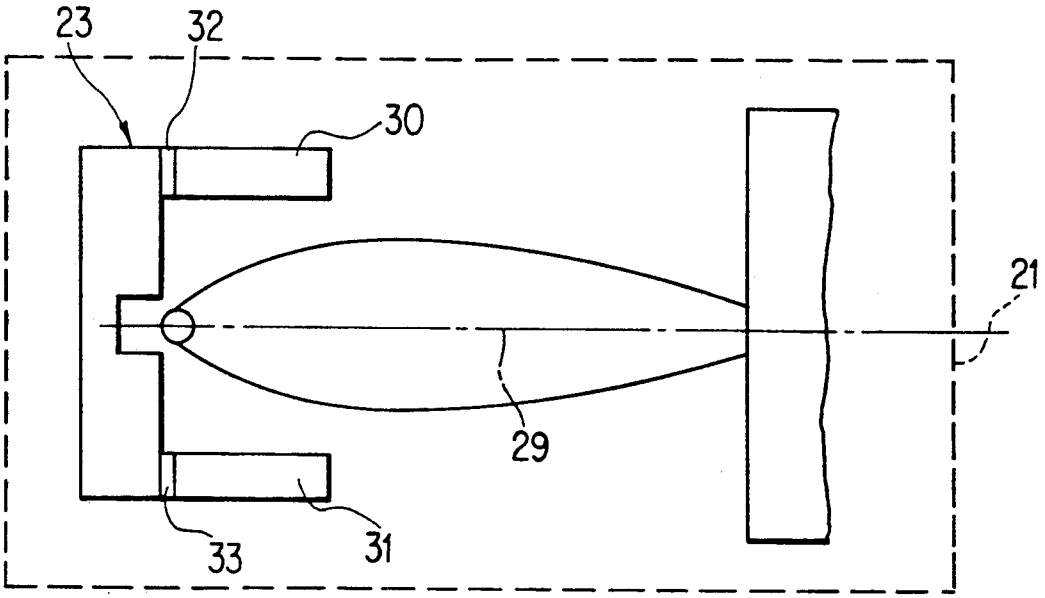
FIG. 6 is a diagram of an alternative embodiment of an x-ray tube in accordance with the invention.

In the schematic example of construction of FIG. 2, focusing of the beam is obtained by means of a cathode having two stair-steps on each side of the filament. Moreover, deflection is obtained by means of two plates located in the external line of extension of the second step. An arrangement of this kind makes it necessary to apply relatively high deflection voltages to said plates since the energy of the beam is already high at the level of the plates. In order to reduce these deflection voltages, it is possible (as shown in FIG. 6) to suppress the last two steps of the cathode and to replace them with deflecting plates which then produce action on a beam having lower energy. This arrangement results in less efficient focusing of the beam since the effect of the focusing device is more limited.

In order to achieve the desired result, many variants may be contemplated such as those described in the foregoing. Others can be added without thereby departing from the scope of the present invention, such as deflecting plates having different lengths and polarized, whether symmetrically or not. In addition, the deflecting plates can have a stair-step profile.

Figure 7:
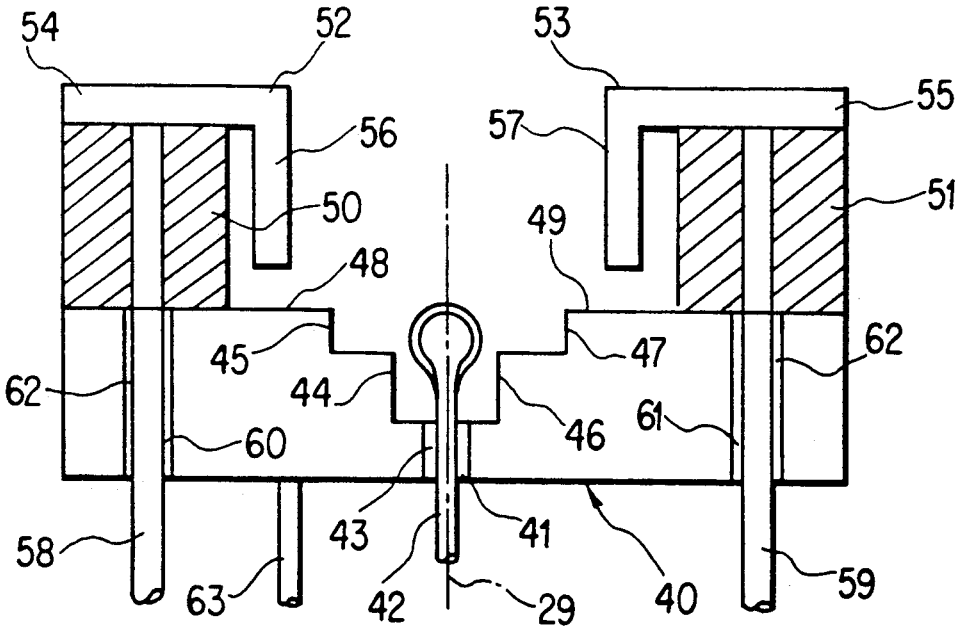
FIGS. 7 and 8 are axial sectional views illustrating forms of construction of cathodes of x-ray tubes in accordance with the invention.
Figure 8:
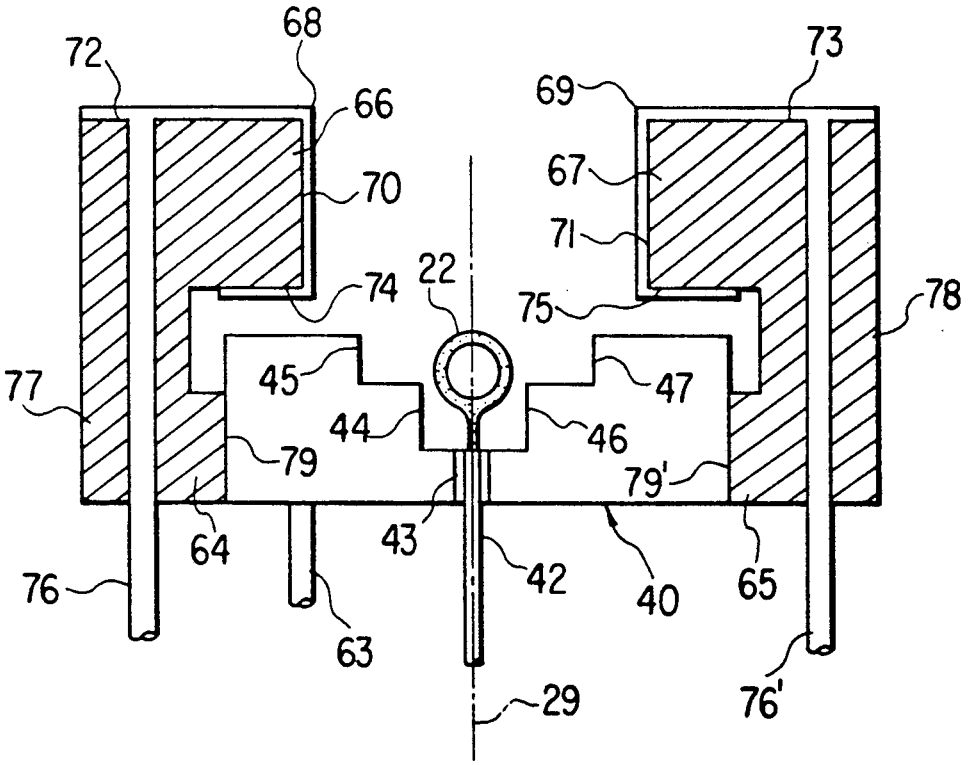

An x-ray tube in accordance with the invention has been described with reference to the diagrammatic views without indicating the mode of construction of the deflecting plates considered which are rigidly fixed to the cathode. FIGS. 7 and 8 show by way of illustration and not in any limiting sense two ways among others of constructing a cathode with deflecting plates in accordance with the present invention. In these figures, the elements which are similar to those of FIG. 2 are designated by the same references.

In the embodiment of FIG. 7, the cathode is constituted by a metallic component 40 pierced at its center with at least one hole 41 through which leads 42 for supplying current to the filament 22 are passed and also serve as a mechanical support for the filament 22. Said leads 42 are insulated from each other and with respect to the metallic component 40 by means of an insulator 43.

In order to obtain the desired focusing of the electron beam, the metallic component 40 is shaped on the side nearest the filament so as to form stair-steps designated on one side by the references 44, 45 and on the other side by the references 46, 47, which place the edges of the component at a distance from the filament. The filament is located at the level of the first step 44 and 46.

Each second step 45 or 47 extends diametrically outwards along a flat face 48 or 49 which serves as a support for an insulating rod 50 or 51. Said insulating rod 50 or 51 virtually constitutes a third step for the focusing device. Each insulating rod 50 or 51 serves as a support for a metallic electrode 52 or 53 which has the shape of a right-angled bracket, one leg 54 or 55 of which is attached to the corresponding rod and the other leg 56 or 57 of which returns in a direction parallel to the central axis of the beam. Said second leg 56 or 57 extends in the direction of the metallic component 40 but stops at a certain distance from this latter in order to prevent any electrical breakdown between the two metallic elements which are brought to different potentials.

Said metallic electrodes 52 and 53, and especially their portion 56 or 57, constitute the deflecting plates described earlier. The deflection voltages are applied to these electrodes 52 and 53 by means of respective conductors 58 and 59 which pass in each case through the associated insulating rod 50 or 51 and the metallic component 40 by means of bores and in particular the bores 60 and 61 which are pierced in the metallic component 40. Provision is clearly made for an insulator 62 between the conductor 58 or 59 and the metallic component 40.

Moreover, the cathode bias voltage is applied by means of a metallic terminal 63.

The insulating rods 50 and 51 can be made of any insulating material which is capable of withstanding high temperatures. This is accordingly the case with alumina. These alumina rods can be welded to the metallic component 40.

In regard to the metallic deflecting electrodes 52 and 53, it is also necessary to make use of metals or metal alloys which afford resistance to high temperatures. It is possible to employ molybdenum which can be welded to the alumina of the insulating rods 50 and 51.

The embodiment of FIG. 8 is similar to that of FIG. 7 in regard to the cathode and its filament but differs from this latter in the mode of construction of the deflecting electrodes. Whereas in FIG. 7, the electrodes 52 and 53 are supported by the flat front face 48 or 49 of the cathode on which the insulating rods are fixed, in FIG. 8, the insulating elements 77 and 78 are fixed on the external lateral face 79 and 79' of the metallic component 40. The insulating elements 77 and 78 comprise two distinct portions, namely in one case the portion 64 or 65 for attachment to the external lateral face 79 and in the other case the portion 66 or 67 for supporting the deflecting electrodes 68 and 69. The insulating portions 66 and 67 are so shaped as to have on the side nearest the filament two opposite faces 70 and 71 which are parallel to the steps of the focusing device. The metallic electrodes 68 and 69 are deposited on said opposite faces 70 and 71 as well as on the top surfaces 72 and 73 and bottom surfaces 74 and 75 of the insulating portions 66 and 67. These electrodes are connected to a voltage supply device (not shown) by means of conductors 76 and 76' which pass through the insulating elements 64 and 65.

It will be observed that the bottom faces 74 and 75 are located at a distance from the metallic component 40 so as to guard against electrical breakdown.

The insulating elements 77 and 78 can be made of any insulating material which is capable of withstanding high temperatures, such as alumina, for example. These elements 77 and 78 can be welded or bonded to the component 40. The material of the electrodes 68 and 69 is a metal or metal alloy which affords resistance to high temperatures such as molybdenum, for example.

What is claimed is:

1. An X-ray tube, comprising within a vacuum enclosure:

a cathode which emits an electron beam having a central axis, said cathode including an electrically heated filament and a device for focusing electrons emitted by said filament so as to obtain a focused electron beam;

an anode on which said electron beam impinges, said anode emitting an X-ray beam as a result thereof; and two electrodes having beam deflecting portions placed parallel to the central axis of said electron beam, said two electrodes being electrically insulated from said cathode and said anode and being each attached to said focusing device via an insulating element proximate to said cathode, said electrodes being at selectively applied different electrical potentials with respect to each other and with respect to said cathode, said anode and said filament so as to deflect a position of said focused electron beam on said anode.

2. An X-ray tube according to claim 1, comprising said insulating element being made of alumina.

3. An X-ray tube according to claim 1, comprising said electrical potentials applied to said deflecting electrodes being of equal but opposite polarity.

4. An X-ray tube according to claim 1, wherein said deflecting electrodes comprise flat metallic plates disposed opposite each other, said flat metallic plates projecting from said insulating element towards said anode.

5. An X-ray tube according to claim 1, comprising said insulating element projecting from said focusing device towards said anode and said deflecting electrodes being made of L-shaped metallic plates, one portion of said plates being attached to a projected end of said insulating element and another portion of said plates being disposed parallel to said central axis of said electron beam.

6. An X-ray tube according to claim 1, comprising said insulating element projecting from said focusing device towards said anode and said deflecting electrodes being made of a metal or metal alloy deposited on said insulating elements.

7. An X-ray tube according to claim 5, comprising said deflecting electrodes each having a portion nearest said filament disposed parallel to said central axis and said deflecting electrodes being connected to rods insulatingly disposed through said focusing device for application thereof of a voltage potential.

8. An x-ray tube according to claim 6, comprising said deflecting electrodes each having a portion nearest said filament disposed parallel to said central axis and said deflecting electrodes being connected to rods insulatingly disposed through said focusing device for application thereof of a voltage potential.

9. An X-ray tube according to claim 1, wherein said beam deflecting portions of said electrodes have a length of approximately 3 mm.

10. An X-ray tube according to claim 7, wherein said beam deflecting portions of said electrodes have a length of approximately 3 mm.

* * * * *